US011791070B2

(12) United States Patent
Tsuchida et al.

(10) Patent No.: US 11,791,070 B2
(45) Date of Patent: Oct. 17, 2023

(54) NTC THERMISTOR ELEMENT

(71) Applicant: TDK CORPORATION, Tokyo (JP)

(72) Inventors: Daisuke Tsuchida, Tokyo (JP); Takehiko Abe, Tokyo (JP); Yoshihiko Satoh, Tokyo (JP); Koki Yamada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/635,841

(22) PCT Filed: Sep. 28, 2020

(86) PCT No.: PCT/JP2020/036658
§ 371 (c)(1),
(2) Date: Feb. 16, 2022

(87) PCT Pub. No.: WO2021/065807
PCT Pub. Date: Apr. 8, 2021

(65) Prior Publication Data

US 2022/0301748 A1 Sep. 22, 2022

(30) Foreign Application Priority Data

Oct. 2, 2019 (JP) ..... 2019-182346

(51) Int. Cl.
*H01C 1/14* (2006.01)
*H01C 7/04* (2006.01)

(52) U.S. Cl.
CPC ..... *H01C 1/1413* (2013.01); *H01C 7/041* (2013.01)

(58) Field of Classification Search
CPC ..... H01C 1/1413; H01C 7/041
See application file for complete search history.

(56) References Cited

U.S. PATENT DOCUMENTS 6,163,246 A * 12/2000 Ueda ..... H01C 1/146 338/331
7,135,955 B2 * 11/2006 Feichtinger ..... H01C 7/041 257/703

(Continued)

FOREIGN PATENT DOCUMENTS

JP 2003-124006 A 4/2003
JP 2003-272903 A 9/2003

(Continued)

OTHER PUBLICATIONS

WO-2014139696, machine translation. (Year: 2014).*

(Continued)

*Primary Examiner* — Kyung S Lee
(74) *Attorney, Agent, or Firm* — Oliff PLC

(57) ABSTRACT

An NTC thermistor element is of less than 0402 size. A first internal electrode is connected to a first external electrode. A second internal electrode is separated from the first internal electrode and is connected to a second external electrode. A third internal electrode opposes the first and second internal electrodes and is not connected to the first external electrode and the second external electrode. A shortest distance between the first internal electrode and the third internal electrode and a shortest distance between the second internal electrode and the third internal electrode are smaller than a shortest distance between the first internal electrode and the second internal electrode, a shortest distance between the first external electrode and the third internal electrode, and a shortest distance between the second external electrode and the third internal electrode, and are less than or equal to ¼ the thickness of the thermistor body.

7 Claims, 8 Drawing Sheets

(56) References Cited

U.S. PATENT DOCUMENTS

| | | | | |
|---|---|---|---|---|
| 7,696,677 | B2 * | 4/2010 | Ito | H01C 7/18 310/365 |
| 8,947,193 | B2 * | 2/2015 | Rinner | H01C 1/1413 338/22 R |
| 10,037,838 | B2 * | 7/2018 | Nawai | H01C 1/1413 |
| 2009/0309691 | A1 * | 12/2009 | Ito | H01C 7/18 338/22 R |
| 2013/0207770 | A1 | 8/2013 | Rinner | |

FOREIGN PATENT DOCUMENTS

| | | | | |
|---|---|---|---|---|
| JP | 2011-091199 | A | 5/2011 | |
| JP | 2013-539605 | A | 10/2013 | |
| JP | 6428797 | B2 | 11/2018 | |
| JP | 2019-164899 | A | 9/2019 | |
| WO | WO-2014139696 | A1 * | 9/2014 | H01C 1/146 |

OTHER PUBLICATIONS

Dec. 15, 2020 International Search Report issued in International Patent Application No. PCT/JP2020/036658.

Apr. 5, 2022 International Preliminary Report on Patentability issued in International Patent Application No. PCT/JP2020/036658.

* cited by examiner

NTC THERMISTOR ELEMENT

TECHNICAL FIELD

The present invention relates to an NTC (Negative Temperature Coefficient) thermistor element.

BACKGROUND ART

A known NTC thermistor element includes a thermistor body, a first external electrode disposed on one end of the thermistor body, a second external electrode disposed on another end of the thermistor body, and a plurality of internal electrodes disposed in the thermistor body (refer to, for example, Patent Literature 1). The NTC thermistor element described in Patent Literature 1 is of equal to or more than 0402 size.

CITATION LIST

Patent Literature

Patent Literature 1: Japanese Patent No. 6428797

SUMMARY OF INVENTION

Technical Problem

With miniaturization or thinning of electronic devices, further miniaturization of NTC thermistor elements is required. Specifically, it is desired to commercialize an NTC thermistor element being of less than 0402 size, for example, 0201 size. However, as the NTC thermistor element is miniaturized, a variation in resistance value increases, so that the NTC thermistor element being of less than 0402 size has not yet been commercialized.

One aspect of the present invention is to provide an NTC thermistor element being of less than 0402 size with a reduced variation in resistance value.

Solution to Problem

The present inventors conducted investigation and research on an NTC thermistor element being of less than 0402 size with a reduced variation in resistance value. As a result, the present inventors have newly obtained the following findings and have accomplished the present invention.

The present inventors established configurations of a plurality of internal electrodes, and after that, focused on a distance (interlayer distance) between the internal electrodes. In the configuration established by the present inventors, the plurality of internal electrodes include a first internal electrode, a second internal electrode, and a third internal electrode. The first internal electrode is connected to a first external electrode. The second internal electrode is separated from the first internal electrode in a first direction in which the first external electrode and a second external electrode oppose each other with a thermistor body interposed therebetween and is connected to the second external electrode. The third internal electrode opposes the first internal electrode and the second internal electrode and is not connected to the first external electrode and the second external electrode.

The NTC thermistor element being of less than 0402 size reduces a variation in resistance value only when the distance between the internal electrodes satisfies the following relationship. That is, unless the distance between the internal electrodes satisfies the following relationship, the NTC thermistor element being of less than 0402 size with the reduced variation in resistance value cannot be realized.

A shortest distance between the first internal electrode and the third internal electrode and a shortest distance between the second internal electrode and the third internal electrode are smaller than a shortest distance between the first internal electrode and the second internal electrode. The shortest distance between the first internal electrode and the third internal electrode and the shortest distance between the second internal electrode and the third internal electrode are smaller than a shortest distance between the first external electrode and the third internal electrode and are smaller than a shortest distance between the second external electrode and the third internal electrode. The shortest distance between the first internal electrode and the third internal electrode and the shortest distance between the second internal electrode and the third internal electrode are less than or equal to ¼ a thickness of the thermistor body in a second direction in which the first and second internal electrodes and the third internal electrode oppose each other.

An NTC thermistor element according to one aspect includes a thermistor body, a first external electrode disposed on one end of the thermistor body, a second external electrode disposed on another end of the thermistor body, and a plurality of internal electrodes disposed in the thermistor body. The plurality of internal electrodes include a first internal electrode, a second internal electrode, and a third internal electrode. The first internal electrode is connected to the first external electrode. The second internal electrode is separated from the first internal electrode in a first direction in which the first external electrode and the second external electrode oppose each other with the thermistor body interposed therebetween and is connected to the second external electrode. The third internal electrode opposing the first internal electrode and the second internal electrode and is not connected to the first external electrode and the second external electrode. A shortest distance between the first internal electrode and the third internal electrode and a shortest distance between the second internal electrode and the third internal electrode are larger than a shortest distance between the first internal electrode and the second internal electrode, a shortest distance between the first external electrode and the third internal electrode, and a shortest distance between the second external electrode and the third internal electrode and are less than or equal to ¼ a thickness of the thermistor body in a second direction in which the first and second internal electrodes and the third internal electrode face each other. The NTC thermistor element is of less than 0402 size.

In the one aspect, even when the NTC thermistor element is of less than 0402 size, the NTC thermistor element reduces a variation in resistance value.

In the one aspect, the NTC thermistor element may be of 0201 size.

A volume of the thermistor body included in the NTC thermistor element being of 0201 size is smaller than a volume of the thermistor body included in the NTC thermistor element being of more than or equal to 0402 size. Therefore, the NTC thermistor element being of 0201 size is excellent in thermal responsiveness.

The one aspect may include a layer covering a surface of the thermistor body and made of a glass material.

The configuration in which the layer made of the glass material covers the surface of the thermistor body ensures electrical insulation of the surface of the thermistor body.

In the one aspect, the plurality of internal electrodes may further include a first dummy electrode and a second dummy electrode. In this case, the first dummy electrode may be separated from the third internal electrode in the first direction and may be connected to the first external electrode, and the second dummy electrode may be separated from the third internal electrode in the first direction and may be connected to the second external electrode.

The configuration in which the plurality of internal electrodes include the first and second dummy electrodes suppresses a variation in distance (interlayer distance) between the internal electrodes. Therefore, this configuration further reduces the variation in the resistance value.

In the one aspect, a length of the first dummy electrode in the first direction may be smaller than a length of the first external electrode in the first direction and may be larger than the shortest distance between the first internal electrode and the third internal electrode and the shortest distance between the second internal electrode and the third internal electrode. A length of the second dummy electrode in the first direction may be smaller than a length of the second external electrode in the first direction and may be larger than the shortest distance between the first internal electrode and the third internal electrode and the shortest distance between the second internal electrode and the third internal electrode.

In this case, the NTC thermistor element being of less than 0402 size further reliably reduces the variation in the resistance value.

In the one aspect, a resistivity (ρ) of the thermistor body may satisfy a relational expression of $$\rho=\alpha\times(S\times n/T)\times R_{25}$$

including: a total value (S) of an area of a region where the first internal electrode and the third internal electrode overlap in the second direction and an area of a region where the second internal electrode and the third internal electrode overlap in the second direction; the number (n) of regions located between the first and second internal electrodes and the third internal electrode in the thermistor body in the second direction; an interval T between the first and second internal electrodes and the third internal electrode in the second direction; a coefficient (a) dependent on a resistance value of a portion other than the thermistor body; and a zero load resistance value ($R_{25}$) at 25° C. in the thermistor body.

Advantageous Effects of Invention

One aspect of the present invention provides an NTC thermistor element being of less than 0402 size with a reduced variation in resistance value.

DESCRIPTION OF EMBODIMENTS

Figure 1:
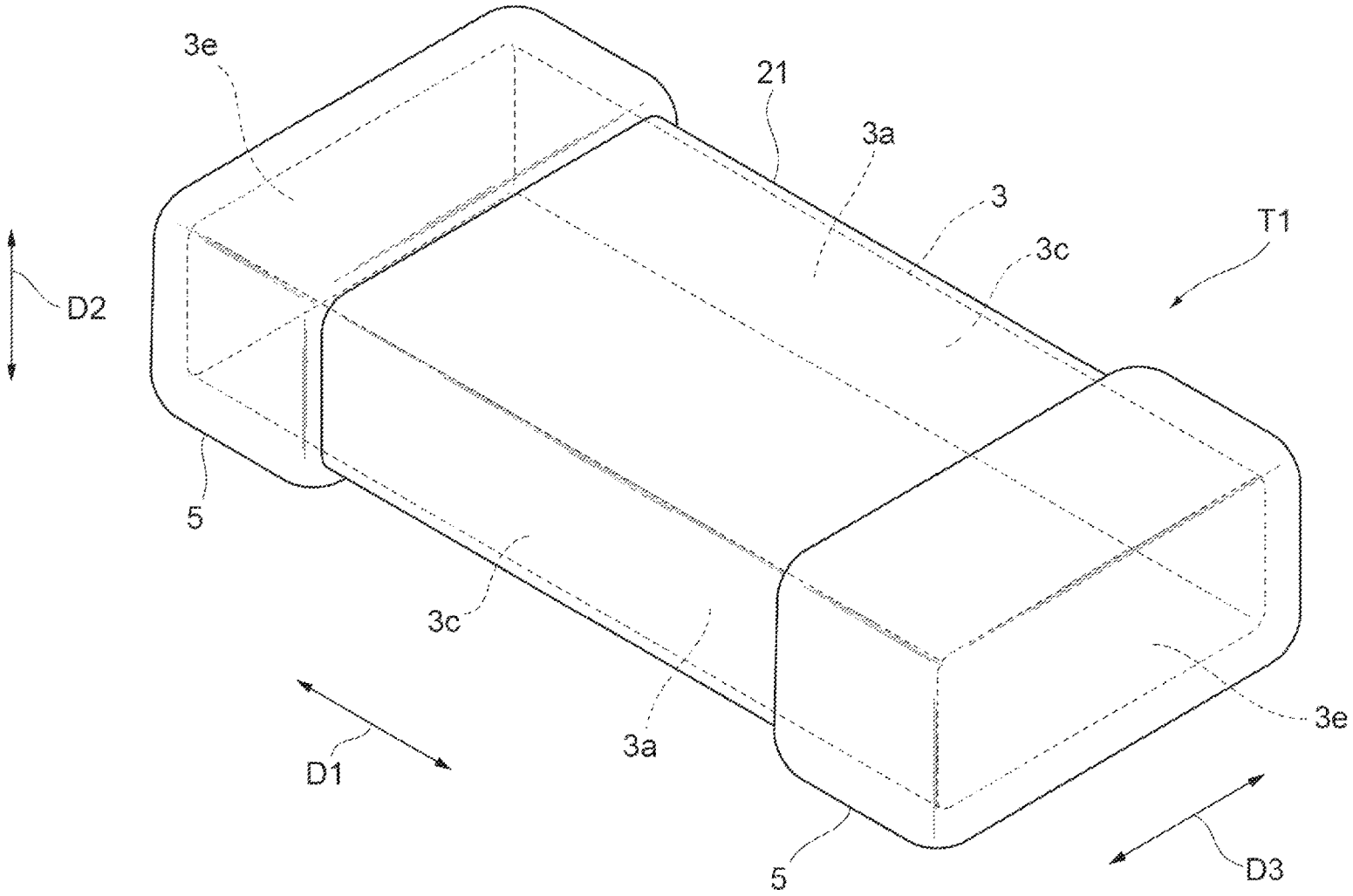
FIG. 1 is a perspective view illustrating an NTC thermistor element according to an embodiment.

Hereinafter, embodiments of the present invention will be described in detail with reference to the accompanying drawings. In the following description, the same elements or elements having the same functions will be denoted with the same reference numerals and overlapped explanation will be omitted.

Figure 2:
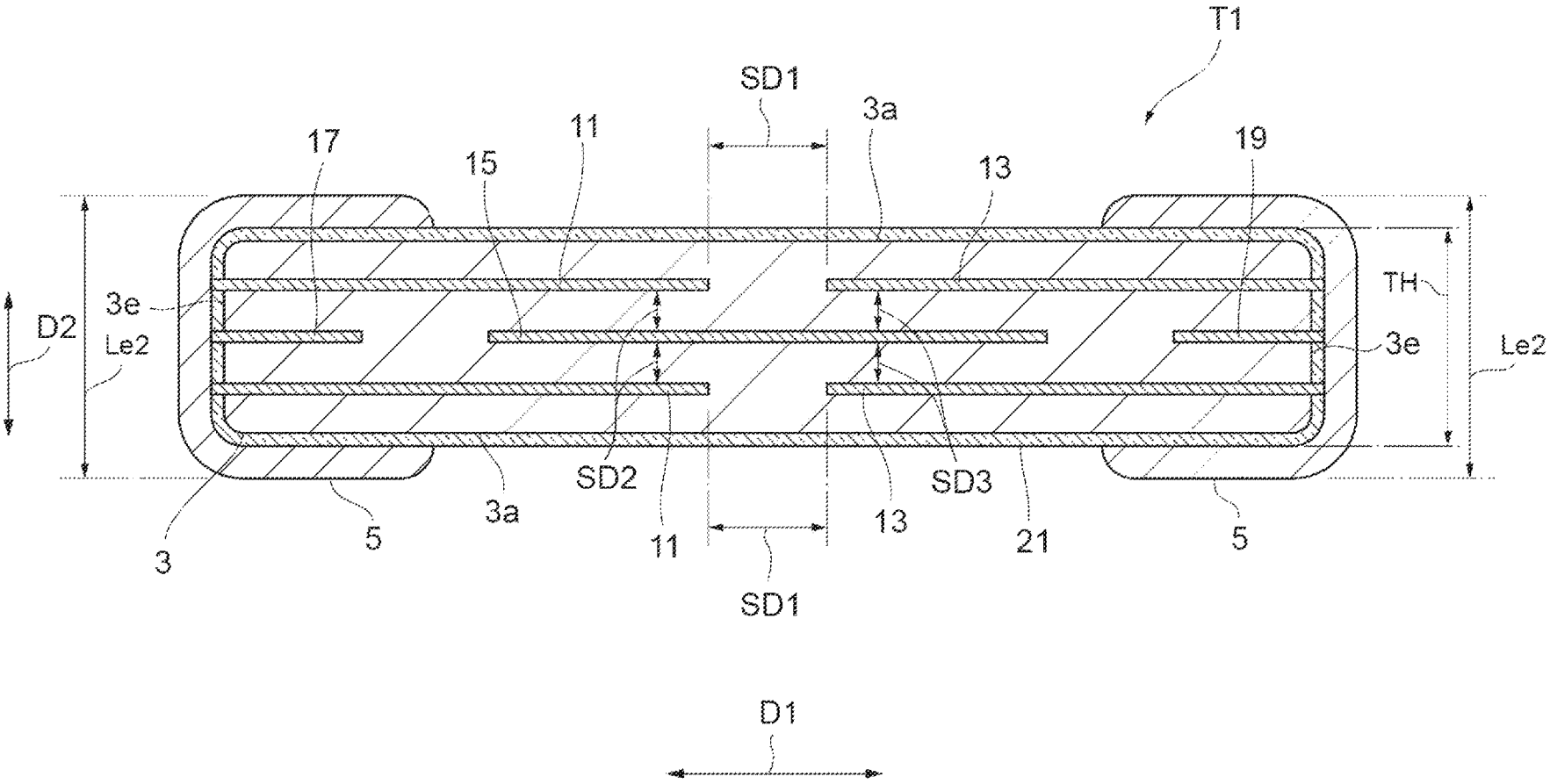
FIG. 2 is a diagram illustrating a cross-sectional configuration of the NTC thermistor element according to the present embodiment.
Figure 3:
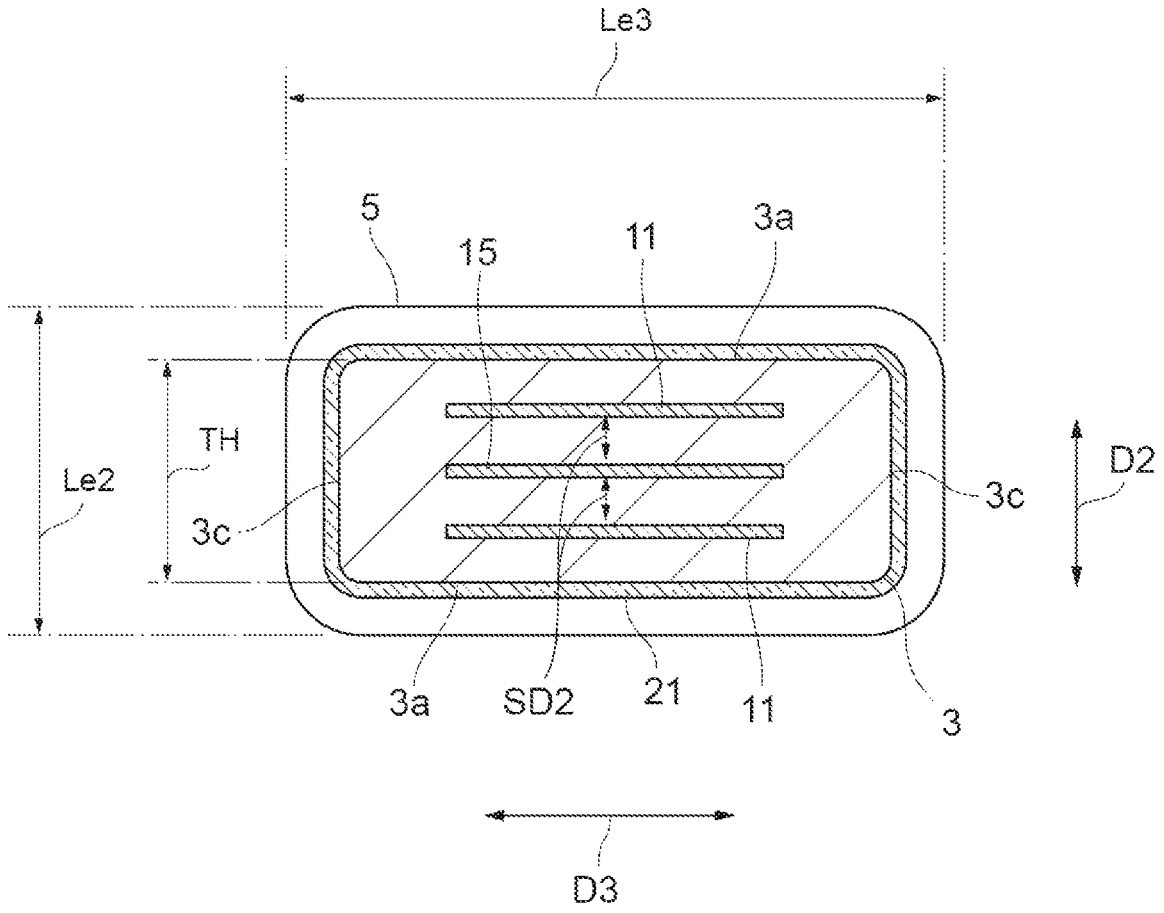
FIG. 3 is a diagram illustrating a cross-sectional configuration of the NTC thermistor element according to the present embodiment.
Figure 4:
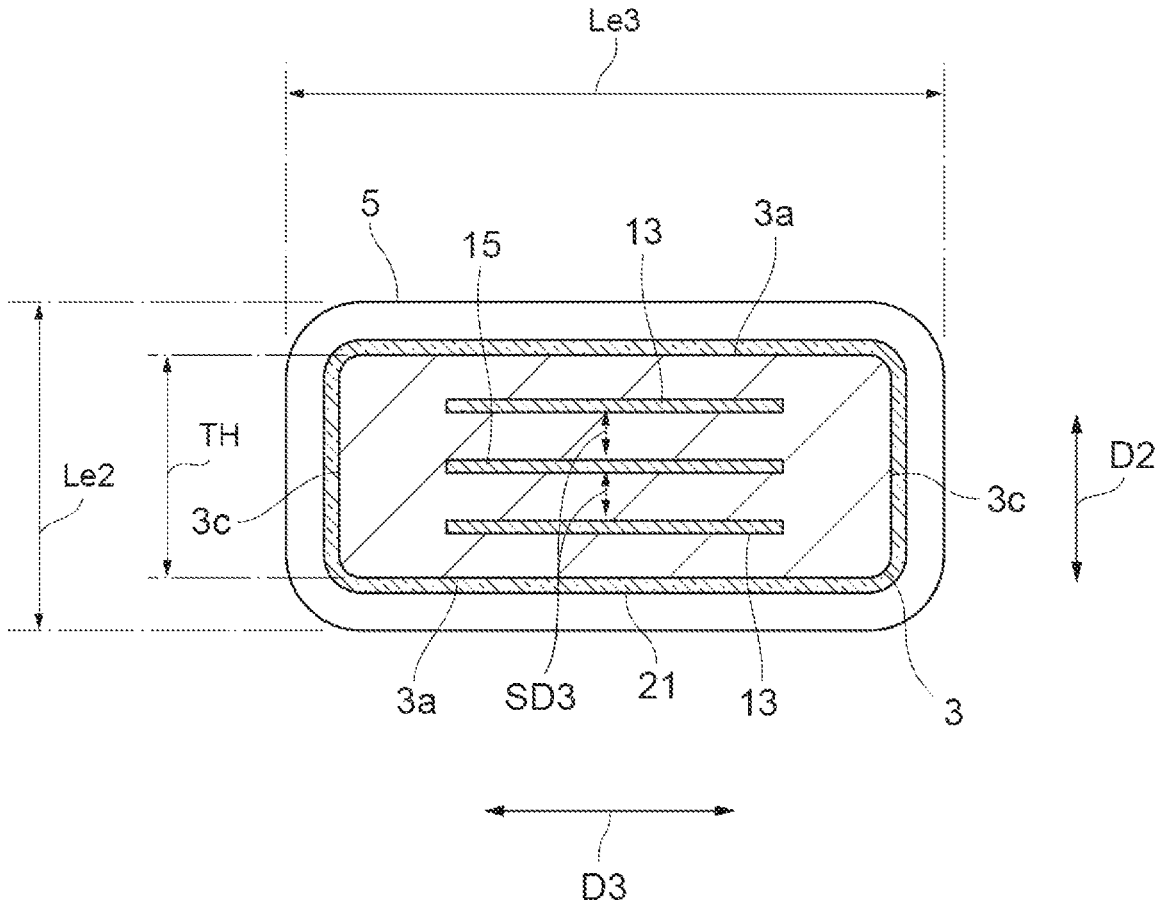
FIG. 4 is a diagram illustrating a cross-sectional configuration of the NTC thermistor element according to the present embodiment.
Figure 5:
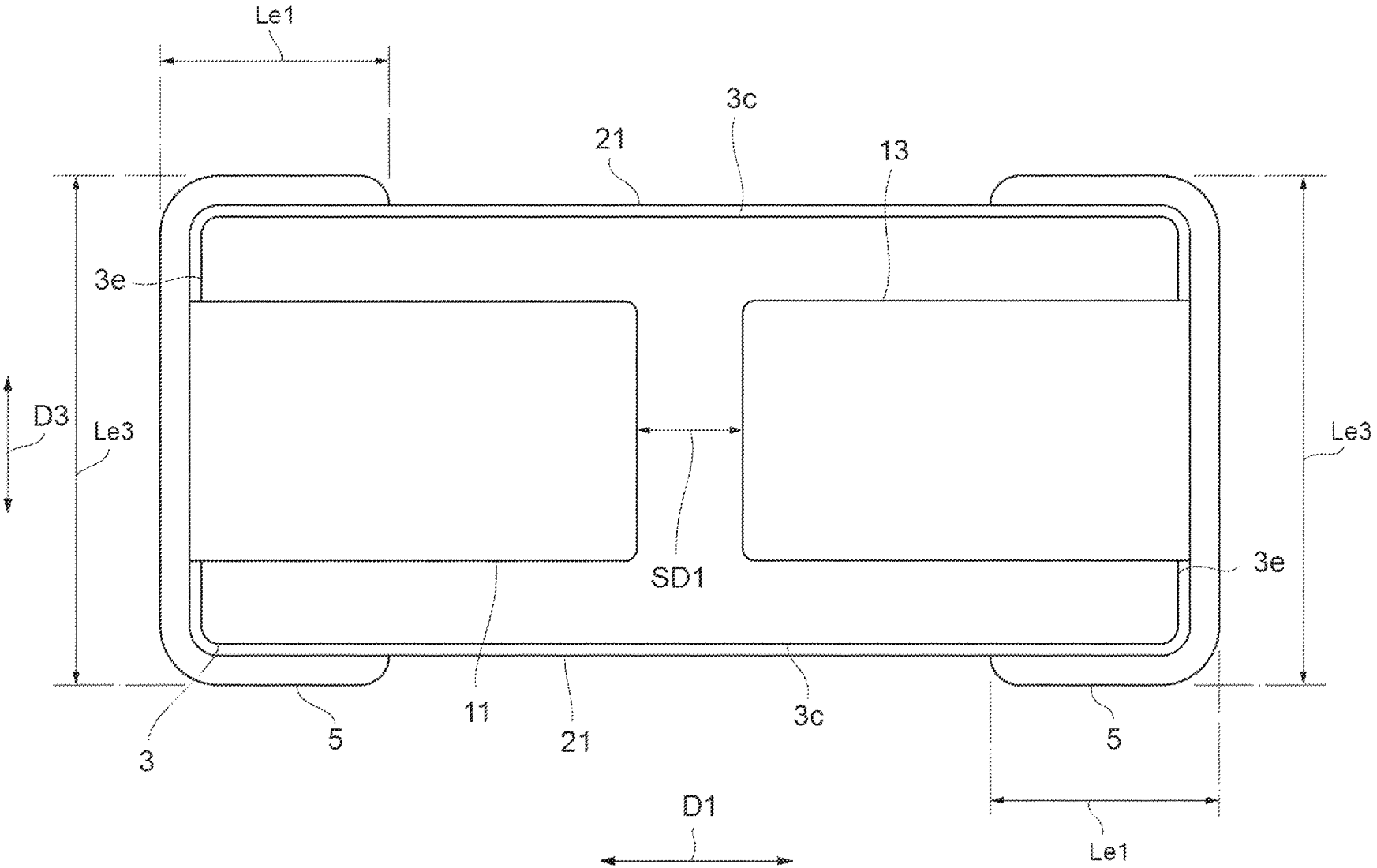
FIG. 5 is a diagram illustrating internal electrodes.
Figure 6:
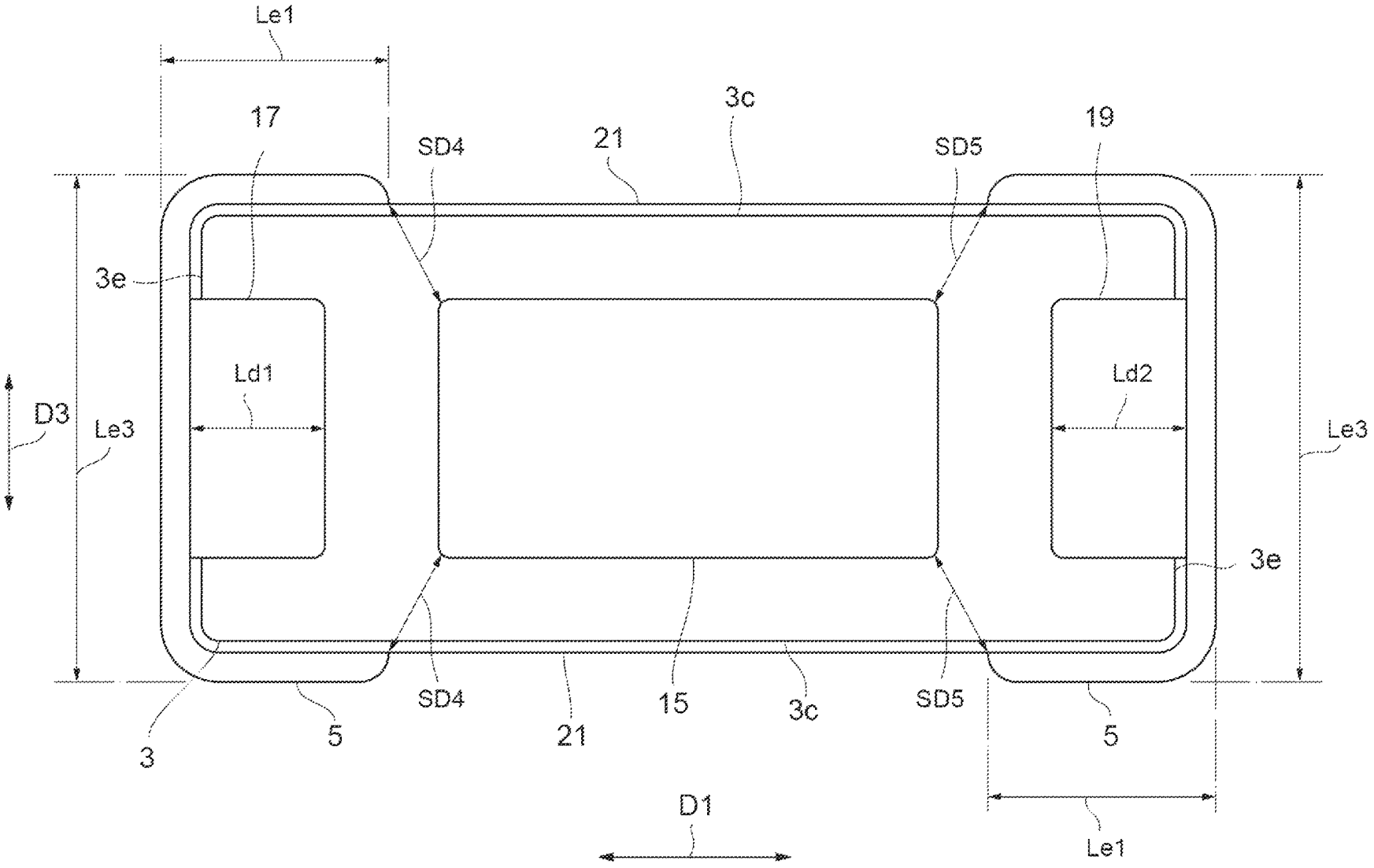
FIG. 6 is a diagram illustrating internal electrodes and dummy electrodes.

A configuration of an NTC thermistor element T1 according to the present embodiment will be described with reference to FIGS. 1 to 6. FIG. 1 is a perspective view illustrating an NTC thermistor element according to the present embodiment. FIG. 2, FIG. 3 and FIG. 4 are diagrams illustrating a cross-sectional configuration of the NTC thermistor element according to the present embodiment. FIG. 5 is a diagram illustrating internal electrodes. FIG. 6 is a diagram illustrating internal electrodes and dummy electrodes.

As illustrated in FIG. 1, the NTC thermistor element T1 includes a thermistor body 3 of a rectangular parallelepiped shape and a plurality of external electrodes 5. In the present embodiment, the NTC thermistor element T1 includes a pair of external electrodes 5. The pair of external electrodes 5 are disposed on an outer surface of the thermistor body 3. The pair of external electrodes 5 are separated from each other. The rectangular parallelepiped shape includes a rectangular parallelepiped shape in which corners and ridges are chamfered or a rectangular parallelepiped shape in which corners and ridges are rounded.

The thermistor body 3 includes a pair of main surfaces 3*a* opposing each other, a pair of side surfaces 3*c* opposing each other, and a pair of end surfaces 3*e* opposing each other. The pair of main surfaces 3*a*, the pair of side surfaces 3*c*, and the pair of end surfaces 3*e* have respective rectangular shapes. The direction in which the pair of end surfaces 3*e* oppose each other is a first direction D1. The direction in which the pair of main surfaces 3*a* oppose each other is a second direction D2. The direction in which the pair of side surfaces 3*c* oppose each other is a third direction D3. The NTC thermistor element T1 is solder-mounted on an electronic device, for example. The electronic device includes, for example, a circuit board or an electronic component. In the NTC thermistor element T1, one of the main surfaces 3*a* opposes the electronic device. The one of the main surfaces 3*a* is arranged to constitute a mounting surface. The one of the main surfaces 3*a* is a mounting surface. Another main surface 3*a* may be arranged to constitute a mounting surface.

The first direction D1 is a direction orthogonal to each end surface 3*e* and is orthogonal to the second direction D2. The second direction D2 is a direction orthogonal to each main surface 3*a*, and the third direction D3 is a direction orthogonal to each side surface 3*c*. The third direction D3 is a direction parallel to each main surface 3*a* and each end surface 3*e*, and is orthogonal to the first direction D1 and the second direction D2. The pair of side surfaces 3*c* extend in the second direction D2 to couple the pair of main surfaces 3*a*. The pair of side surfaces 3*c* also extend in the first direction D1. The pair of end surfaces 3*e* extend in the second direction D2 to couple the pair of main faces 3*a*. The pair of end surfaces 3*e* also extend in the third direction D3.

A length of the thermistor body 3 in the first direction D1 is the length of the thermistor body 3. A length of the thermistor body 3 in the second direction D2 is a thickness TH of the thermistor body 3. A length of the thermistor body 3 in the third direction D3 is a width of the thermistor body 3. The length of the thermistor body 3 is less than 0.4 mm. The width of the thermistor body 3 is less than 0.2 mm. The thickness TH of the thermistor body 3 is less than 0.2 mm.

In the present embodiment, the length of the thermistor body 3 is, for example, 0.225 mm, and the length of the NTC thermistor element T1 in the first direction D1 is, for example, 0.240 mm. The width of the thermistor body 3 is, for example, 0.1 mm, and the length of the NTC thermistor element T1 in the third direction D3 is, for example, 0.115 mm. The NTC thermistor element T1 is of 0201 size in JIS notation. The NTC thermistor element T1 is of 008004 size in EIA notation. In the present embodiment, the thickness TH of the thermistor body 3 is, for example, 0.0446 mm, and the length of the NTC thermistor element T1 in the second direction D2 is, for example, 0.0596 mm That is, the NTC thermistor element T1 has a low profile.

The thermistor body 3 is configured through laminating a plurality of thermistor layers in the second direction D2. The thermistor body 3 includes the plurality of laminated thermistor layers. In the thermistor body 3, a lamination direction of the plurality of thermistor layers coincides with the second direction D2. Each thermistor layer is configured with, for example, a sintered body of a ceramic green sheet including an NTC thermistor material that functions as an NTC thermistor. The NTC thermistor material is, for example, a semiconductor ceramic material. The NTC thermistor material contains, for example, a composite oxide having a spinel structure as a principal component. The composite oxide includes two or more elements selected from transition metal elements such as Mn, Ni, Co, and Fe. The NTC thermistor material may include an accessory component, for example, to improve characteristics. The accessory component includes, for example, Cu, Al, or Zr. The composition and content of the principal component and the accessory component are appropriately determined in accordance with characteristics required for the NTC thermistor element T1. In an actual thermistor body 3, each thermistor layer is integrated to the extent that boundaries between the thermistor layers cannot be visually recognized.

As illustrated in FIG. 1, the external electrodes 5 are disposed on both ends of the thermistor body 3 in the first direction D1. One of the external electrodes 5 is disposed on one end of the thermistor body 3. The other external electrode 5 is disposed on another end of the thermistor body 3. Each external electrode 5 is disposed on the corresponding end surface 3*e* side of the thermistor body 3. The external electrode 5 is disposed on at least the end surface 3*e* and the one of the main surfaces 3*a*. In the present embodiment, each external electrode 5 is disposed on the pair of main surfaces 3*a*, the pair of side surfaces 3*c*, and the one end surface 3*e*. The external electrodes 5 are formed on five surfaces that include the pair of main surfaces 3*a*, the one end surface 3*e*, and the pair of side surfaces 3*c*. As illustrated in FIGS. 2 to 4, the external electrode 5 includes a portion located on each main surface 3*a*, a portion located on each side surface 3*c*, and a portion located on the end surface 3*e*. For example, when the one of the external electrodes 5 constitutes a first external electrode, the other external electrode 5 constitutes a second external electrode. The pair of external electrodes 5 oppose each other in the first direction D1 with the thermistor body 3 interposed therebetween. The pair of external electrodes 5 are separated from each other in the first direction D1.

The external electrode 5 includes a sintered metal layer. Each portion of the external electrode 5 includes the sintered metal layer. The sintered metal layer is formed from sintering electrically conductive paste applied onto the surface of the thermistor body 3. The sintered metal layer is formed from sintering a metal component (metal powder) included in the electrically conductive paste. The sintered metal layer is made of a noble metal or a noble metal alloy. The noble metal includes, for example, Ag, Pd, Au, or Pt. The noble metal alloy includes, for example, an Ag—Pd alloy. The sintered metal layer may be made of a base metal or a base metal alloy. The base metal includes, for example, Cu or Ni. The electrically conductive paste includes, for example, the metal powders described above, a glass component, an organic binder, and an organic solvent.

The external electrode 5 may include a plating layer. The plating layer is formed on the sintered metal layer to cover the sintered metal layer. The plating layer may have a two-layer structure. A first layer includes, for example, an Ni plating layer, an Sn plating layer, a Cu plating layer, or an Au plating layer. A second layer formed on the first layer includes, for example, an Sn plating layer, an Sn—Ag alloy plating layer, an Sn—Bi alloy plating layer, or an Sn—Cu alloy plating layer. The plating layer may have a layer structure of three or more layers.

A length Le1 of each external electrode 5 in the first direction D1 is, for example, 50 to 90 μm. A length Le2 of each external electrode 5 in the second direction D2 is, for example, 50 to 140 μm. A length Le3 of each external electrode 5 in the third direction D3 is, for example, 110 to 140 μm. In the present embodiment, the length Le1 is 50 μm, the length Le2 is 59.6 μm, and the length Le3 is 115 μm. In the present embodiment, the length Le1 of each external electrode 5 is equal, the length Le2 of each external electrode 5 is equal, and the length Le3 of each external electrode 5 is equal.

The NTC thermistor element T1 includes a plurality of internal electrodes, as also illustrated in FIGS. 5 and 6. The plurality of internal electrodes are disposed in the thermistor body 3. The plurality of internal electrodes include a plurality of internal electrodes 11, 13, and 15 and a plurality of dummy electrodes 17 and 19. In the present embodiment, the plurality of internal electrodes include two internal electrodes 11, two internal electrodes 13, single internal electrode 15, single dummy electrode 17, and single dummy electrode 19. For example, when the internal electrode 11 constitutes a first internal electrode, the internal electrode 13 constitutes a second internal electrode and the internal electrode 15 constitutes a third internal electrode. For example, when the dummy electrode 17 constitutes a first dummy electrode, the dummy electrode 19 constitutes a second dummy electrode.

The plurality of internal electrodes 11, 13, and 15 and the plurality of dummy electrodes 17 and 19 are made of a noble metal or a noble metal alloy, similarly to the external electrode 5. The noble metal includes, for example, Ag, Pd, Au, or Pt. The noble metal alloy includes, for example, an Ag—Pd alloy. The plurality of internal electrodes 11, 13, and 15 and the plurality of dummy electrodes 17 and 19 may be made of a base metal or a base metal alloy. The base metal includes, for example, Cu or Ni. The internal electrodes 11, 13, and 15 and the dummy electrodes 17 and 19 are internal conductors disposed in the thermistor body 3. Each of the internal electrodes 11, 13, and 15 and each of the dummy electrodes 17 and 19 are made of electrically conductive material. The plurality of internal electrodes 11, 13, and 15 and the plurality of dummy electrodes 17 and 19 are configured as a sintered body of an electrically conductive paste containing the electrically conductive material described above.

The internal electrode 11 has a rectangular shape when viewed from the second direction D2. A length of the internal electrode 11 in the first direction D1 is less than half the length of the thermistor body 3. A length of the internal electrode 11 in the third direction D3 is smaller than the width of the thermistor body 3. In this specification, the "rectangular shape" includes, for example, a shape in which each corner is chamfered or a shape in which each corner is rounded. The length of the internal electrode 11 in the first direction D1 is, for example, 90 to 110 μm. The length of the internal electrode 11 in the third direction D3 is, for example, 45 to 75 μm. A thickness of the internal electrode 11 is, for example, 0.5 to 3.0 μm. In the present embodiment, the length of the internal electrode 11 in the first direction D1 is 100 μm, the length of the internal electrode 11 in the third direction D3 is 60 μm, and the thickness of the internal electrode 11 is 2.0 μm.

The two internal electrodes 11 are disposed in different positions (layers) in the second direction D2. Each of the internal electrodes 11 includes one end exposed to one of the end surfaces 3*e*. The portion included in the one of the external electrodes 5 and located on the end surface 3*e* covers the one end of each internal electrode 11. Each of the internal electrodes 11 is directly connected to the one of the external electrodes 5 at the one end exposed to the one of end surfaces 3*e*. Each of the internal electrodes 11 is electrically connected to the one of the external electrodes 5.

The internal electrode 13 has a rectangular shape when viewed from the second direction D2. A length of the internal electrode 13 in the first direction D1 is less than half the length of the thermistor body 3. A length of the internal electrode 13 in the third direction D3 is smaller than the width of the thermistor body 3. The length of the internal electrode 13 in the first direction D1 is, for example, 90 to 110 μm. The length of the internal electrode 13 in the third direction D3 is, for example, 45 to 75 μm. A thickness of the internal electrode 13 is, for example, 0.5 to 3.0 μm. In the present embodiment, the length of the internal electrode 13 in the first direction D1 is 100 μm, the length of the internal electrode 13 in the third direction D3 is 60 μm, and the thickness of the internal electrode 13 is 2.0 μm. In the present embodiment, the shape of the internal electrode 11 and the shape of the internal electrode 13 are equal. In this specification, the term "equal" does not necessarily mean only that values are matched. Even in the case where a slight difference in a predetermined range, it can be defined that shapes are equal to each other.

The two internal electrodes 13 are disposed in different positions (layers) in the second direction D2. Each of the internal electrodes 13 includes one end exposed to another end surface 3*e*. The portion included in the other external electrode 5 and located on the end surface 3*e* covers the one end of each internal electrode 13. Each of the internal electrodes 13 is directly connected to the other external electrode 5 at the one end exposed to the other end surface 3*e*. Each of the internal electrodes 13 is electrically connected to the other external electrode 5.

Each of the internal electrodes 13 is disposed in the same position (layer) as a corresponding internal electrode 11 of the two internal electrodes 11 in the second direction D2. The internal electrode 11 and the internal electrode 13 are located in the same layer. The internal electrode 11 and the internal electrode 13 are separated from each other in the first direction D1, oppose is, in the direction in which the pair of external electrodes 5 face each other with the thermistor body 3 interposed therebetween. A shortest distance SD1 between the internal electrode 11 and the internal electrode 13 is, for example, 5 to 58 μm. In the present embodiment, the shortest distance SD1 is 25 μm.

The internal electrode 15 has a rectangular shape when viewed from the second direction D2. A length of the internal electrode 15 in the third direction D3 is smaller than the width of the thermistor body 3. A length of the internal electrode 15 in the first direction D1 is, for example, 90 to 168 μm. The length of the internal electrode 15 in the third direction D3 is, for example, 45 to 75 μm. A thickness of the internal electrode 15 is, for example, 0.5 to 3.0 μm. In the present embodiment, the length of the internal electrode 15 in the first direction D1 is 112 μm, the length of the internal electrode 15 in the third direction D3 is 60 μm, and the thickness of the internal electrode 15 is 2.0 μm.

The internal electrodes 15 and the internal electrodes 11 and 13 are disposed in different positions (layers) in the second direction D2. The internal electrode 15 includes no end exposed to the surface of the thermistor body 3. Therefore, the internal electrode 15 is not connected to each of the external electrodes 5. The internal electrode 15 opposes the internal electrodes 11 and 13 in the second direction D2. The internal electrodes 15 and the internal electrodes 11 and 13 are disposed in the thermistor body 3 to oppose each other with an interval in the second direction D2. The internal electrode 15 is located between a layer in which a set of the internal electrodes 11 and 13 corresponding to each other are located and a layer in which another set of the internal electrodes 11 and 13 corresponding to each other are located. In the present embodiment, a layer in which the internal electrode 15 is located is located in a substantially intermediate portion between the layer in which the set of the internal electrodes 11 and 13 are located and the layer in which the other set of internal electrodes 11 and 13 are located. The internal electrode 15 includes a portion opposing the internal electrode 11, a portion opposing the internal electrode 13, and a portion not opposing the internal electrodes 11 and 13. The portion not opposing the internal electrodes 11 and 13 is located between the portion opposing the internal electrode 11 and the portion opposing the internal electrode 13.

A shortest distance SD2 between the internal electrode 11 and the internal electrode 15 is, for example, 3.0 to 31.3 μm. In the present embodiment, the shortest distance SD2 between one of the internal electrodes 11 and the internal electrode 15 and the shortest distance SD2 between another internal electrode 11 and the internal electrode 15 are equal. In the present embodiment, the shortest distance SD2 is 9.2 μm.

A shortest distance SD3 between the internal electrode 13 and the internal electrode 15 is, for example, 3.0 to 31.3 μm. In the present embodiment, the shortest distance SD3 between one of the internal electrodes e 13 and the internal electrode 15 and the shortest distance SD3 between another internal electrode 13 and the internal electrode 15 are equal. In the present embodiment, the shortest distance SD3 is 9.2 μm and is equal to the shortest distance SD2. The shortest distances SD2 and SD3 are also a minimum thickness of the thermistor layer located between the internal electrodes 15 and the internal electrodes 11 and 13. The shortest distances SD2 and SD3 are smaller than the shortest distance SD1.

The shortest distances SD2 and SD3 are less than or equal to ¼ the thickness TH of the thermistor body 3.

A shortest distance SD4 between the internal electrode 15 and the one of the external electrodes 5 is, for example, 17.5 to 30.5 μm. In the present embodiment, as illustrated in FIG. 6, the shortest distance SD4 is a shortest distance between a corner of the internal electrode 15 and an end edge of the one of the external electrodes 5. The internal electrode 15 includes one corner near the one of the external electrodes 5 and another corner near the one of the external electrodes 5, and the shortest distance SD4 between the one corner near the one of the external electrodes 5 and the end edge of the one of the external electrodes 5 opposing the one corner and the shortest distance SD4 between the other corner near the one of the external electrodes 5 and the end edge of the one of the external electrodes 5 opposing the other corner are equal. In the present embodiment, the shortest distance SD4 is 24.4 μm.

A shortest distance SD5 between the internal electrode 15 and the other external electrode 5 is, for example, 17.5 to 30.5 μm. In the present embodiment, as illustrated in FIG. 6, the shortest distance SD5 is a shortest distance between a corner of the internal electrode 15 and an end edge of the other external electrode 5. The internal electrode 15 includes one corner near the other external electrodes 5 and another corner near the other external electrodes 5, and the shortest distance SD5 between the one corner near the other external electrodes 5 and the end edge of the other external electrode 5 opposing the one corner and the shortest distance SD5 between the other corner near the other external electrode 5 and the end edge of the other external electrode 5 opposing the other corner are equal. In the present embodiment, the shortest distance SD5 is 24.4 μm and is equal to the shortest distance SD4. The shortest distances SD2 and SD3 are smaller than the shortest distances SD4 and SD5.

The dummy electrode 17 has a rectangular shape when viewed from the second direction D2. A length of the dummy electrode 17 in the third direction D3 is smaller than the width of the thermistor body 3.

A length Ld1 of the dummy electrode 17 in the first direction D1 is, for example, 10 to 65 μm. A length of the dummy electrode 17 in the third direction D3 is, for example, 45 to 75 μm. A thickness of the dummy electrode 17 is, for example, 0.5 to 3.0 μm. In the present embodiment, the length Ld1 of the dummy electrode 17 in the first direction D1 is 30 μm, the length of the dummy electrode 17 in the third direction D3 is 60 μm, and the thickness of the dummy electrode 17 is 2.0 μm. The length of the dummy electrode 17 in the third direction D3 is equal to the length of the internal electrode 15 in the third direction D3.

The dummy electrode 17 is disposed in the same position (layer) as the internal electrode 15 in the second direction D2. The dummy electrode 17 and the internal electrode 15 are separated from each other in the first direction D1, that is, in the direction in which the pair of external electrodes 5 oppose each other with the thermistor body 3 interposed therebetween. The dummy electrode 17 and the internal electrode 11 are disposed in the thermistor body 3 to oppose each other with an interval in the second direction D2. The dummy electrode 17 is located between the layer in which the one of the internal electrodes 11 is located and the layer in which the other internal electrode 11 is located. In the present embodiment, a layer in which the dummy electrode 17 is located is located in a substantially intermediate portion between the layer in which the one of the internal electrodes 11 is located and the layer in which the other internal electrode 11 is located. When viewed from the second direction D2, the entire dummy electrode 17 overlaps the internal electrode 11.

The dummy electrode 17 includes one end exposed to the one of the end surfaces 3*e*. The portion included in the one of the external electrodes 5 and located on the end surface 3*e* covers the one end of the dummy electrode 17. The dummy electrode 17 is directly connected to the one of the external electrodes 5 at the one end exposed to the one of the end surfaces 3*e*. The dummy electrode 17 is electrically connected to the one of the external electrodes 5. The length Ld1 of the dummy electrode 17 is smaller than the length Le1 of the external electrode 5 to which the dummy electrode 17 is connected. The length Ld1 of the dummy electrode 17 is larger than the shortest distances SD2 and SD3.

The dummy electrode 19 has a rectangular shape when viewed from the second direction D2. A length of the dummy electrode 19 in the third direction D3 is smaller than the width of the thermistor body 3. The length Ld2 of the dummy electrode 19 in the first direction D1 is, for example, 10 to 65 μm. The length of the dummy electrode 19 in the third direction D3 is, for example, 45 to 75 μm. A thickness of the dummy electrode 19 is, for example, 0.5 to 3.0 μm. In the present embodiment, the length Ld2 of the dummy electrode 19 in the first direction D1 is 30 μm, the length of the dummy electrode 19 in the third direction D3 is 60 μm, and the thickness of the dummy electrode 19 is 2.0 μm. The length of the dummy electrode 19 in the third direction D3 is equal to the length of the internal electrode 15 in the third direction D3. In the present embodiment, the shape of the dummy electrode 17 and the shape of the dummy electrode 19 are equal. The length Ld1 and the length Ld2 are equal.

The dummy electrode 19 is disposed in the same position (layer) as the internal electrode 15 in the second direction D2. The dummy electrode 19 and the internal electrode 15 are separated from each other in the first direction D1, that is, in the direction in which the pair of external electrodes 5 oppose each other with the thermistor body 3 interposed therebetween. The dummy electrode 19 and the internal electrode 13 are disposed in the thermistor body 3 to oppose each other with an interval in the second direction D2. The dummy electrode 19 is located between the layer in which the one of the internal electrodes 13 is located and the layer in which the other internal electrode 13 is located. In the present embodiment, a layer in which the dummy electrode 19 is located is located in a substantially intermediate portion between the layer in which the one of the internal electrodes 13 is located and the layer in which the other internal electrode 13 is located. When viewed from the second direction D2, the entire dummy electrode 19 overlaps the internal electrode 13.

The dummy electrode 19 includes one end exposed to the other end surface 3*e*. The portion included in the other external electrode 5 and located on the end surface 3*e* covers the one end of the dummy electrode 19. The dummy electrode 19 is directly connected to the other external electrode 5 at the one end exposed to the other end surface 3*e*. The dummy electrode 19 is electrically connected to the other external electrode 5. The length Ld2 of the dummy electrode 19 is smaller than the length Le1 of the external electrode 5 to which the dummy electrode 19 is connected. The length Ld2 of the dummy electrode 19 is larger than the shortest distances SD2 and SD3.

The NTC thermistor element T1 includes a coating layer 21 as also illustrated in FIGS. 2 to 4. The coating layer 21 is formed on the surface of the thermistor body 3 (the pair of main surfaces 3*a*, the pair of side surfaces 3*c*, and the pair of end surfaces 3*e*). The coating layer 21 covers the surface of the thermistor body 3. In the present embodiment, substantially the entire surface of the thermistor body 3 is covered. The coating layer 21 is a layer made of a glass material. A thickness of the coating layer 21 is, for example, 0.01 to 0.5 μm. In the present embodiment, the thickness of the coating layer 21 is 0.15 μm. The glass material is, for example, an $SiO_2$—$Al_2O_3$—$LiO_2$-based crystallized glass. The glass material may be an amorphous glass. The internal electrodes 11 and 13 and the dummy electrodes 17 and 19 penetrate the coating layer 21 and are connected to the corresponding external electrodes 5.

Figure 7:
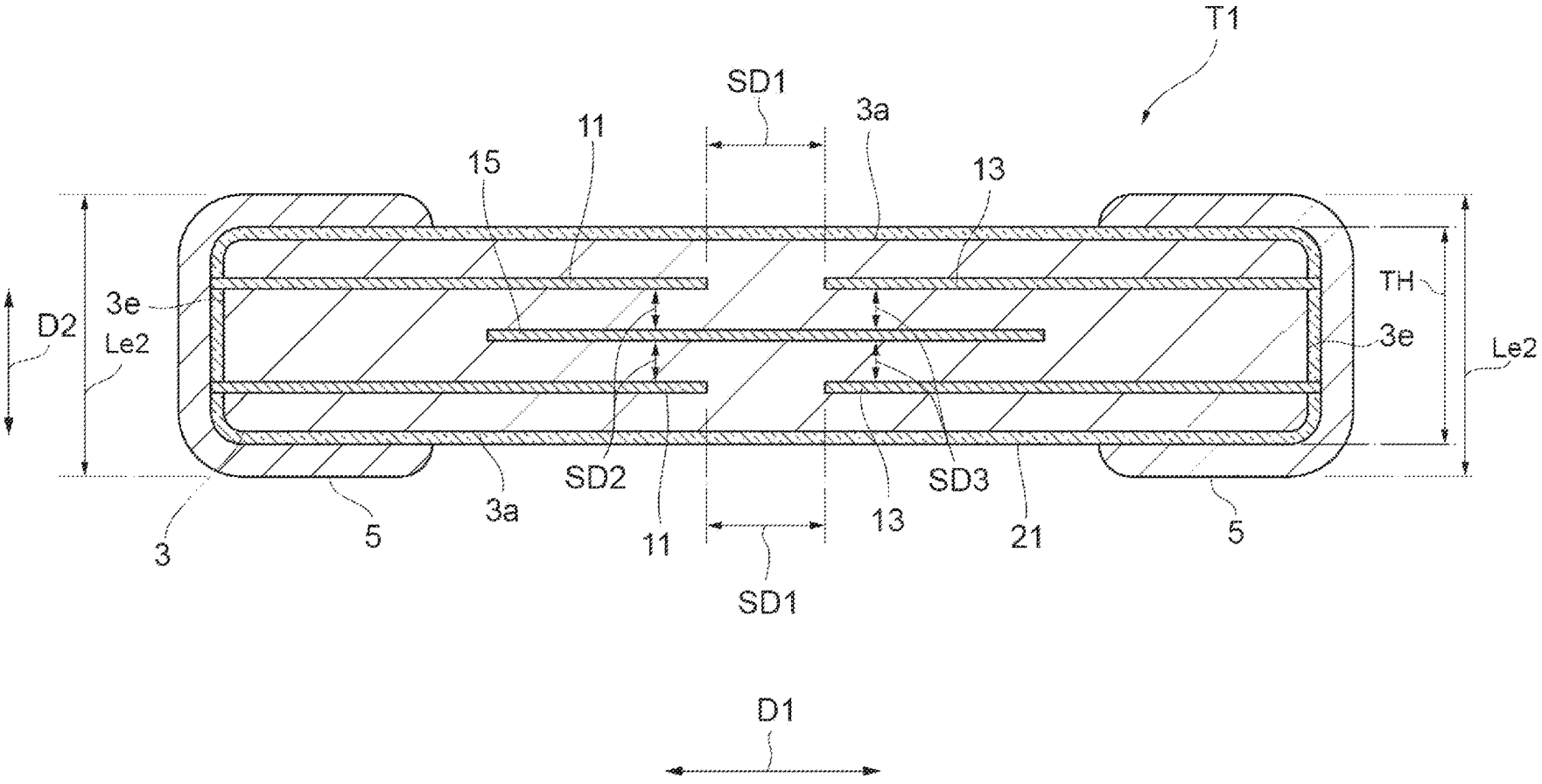
FIG. 7 is a diagram illustrating a relationship between a resistivity (ρ) and a zero load resistance value ($R_{25}$) at 25° C. of the thermistor body.

As also illustrated in FIG. 7, a resistivity (ρ) of the thermistor body 3 satisfies a relational expression of $$\rho=\alpha\times(S\times n/T)\times R_{25}$$

including a zero load resistance value ($R_{25}$) at 25° C. in the thermistor body 3. "S" included in the above relational expression indicates a total value of an area of a region where the internal electrode 11 and the internal electrode 15 overlap each other in the second direction D2 and an area of a region where the internal electrode 13 and the internal electrode 15 overlap each other in the second direction D2. "n" included in the above relational expression indicates the number of regions located between the internal electrodes 11 and 13 and the internal electrodes 15 in the thermistor body 3, in the second direction D2. "T" included in the above relational expression indicates an interval between the internal electrodes 11 and 13 and the internal electrode 15 in the second direction D2. The interval T may be the shortest distances SD2 and SD3. The interval T may be an average value of the intervals between the internal electrodes 11 and 13 and the internal electrode 15 in the second direction D2 in the region where the internal electrode 11 and the internal electrode 15 overlap in the second direction D2 and the region where the internal electrode 13 and the internal electrode 15 overlap in the second direction D2. "α" included in the above relational expression indicates a coefficient dependent on a resistance value of a portion other than the thermistor body 3. The portion other than the thermistor body 3 includes, for example, the internal electrodes 11, 13, and 15 and the external electrodes 5. In the present embodiment, the total value (S) is 5220 $\mu m^2$. The number (n) is 2. The interval (T) is 9.2 μm. The coefficient (α) is 40.54. The zero load resistance value ($R_{25}$) is approximately 100000Ω. The resistivity (ρ) of the thermistor body 3 is approximately 4600 Ω·m. When the resistivity ρ of the thermistor body 3 is relatively small, a variation in overlap areas between the internal electrodes 11 and 13 and the internal electrode 15 has a greater influence on a variation in resistance value than a variation in intervals (interlayer distances) between the internal electrodes 11 and 13 and the internal electrode 15. When the resistivity ρ of the thermistor body 3 is relatively large, the variation in the interlayer distances has a greater influence on the variation in the resistance value than the variation in the overlap area.

The present inventors established configurations of the internal electrodes 11, 13, and 15, and after that, focused the distance (interlayer distance) between the internal electrode 11 and the internal electrode 15 and the distance (interlayer distance) between the internal electrode 13 and the internal electrode 15. The NTC thermistor element T1 being of less than 0402 size reduces the variation in the resistance value only when the distance between the internal electrode 11 and the internal electrode 15 and the distance between the internal electrode 13 and the internal electrode 15 satisfy the following relationships. That is, unless the distance between the internal electrode 11 and the internal electrode 15 and the distance between the internal electrode 13 and the internal electrode 15 satisfy the following relationship, the NTC thermistor element T1 being of less than 0402 size with the reduced the variation in the resistance value is not realized.

Each of the shortest distances SD2 and SD3 is smaller than the shortest distance SD1. Each of the shortest distances SD2 and SD3 is smaller than each of the shortest distances SD4 and SD5. Each of the shortest distances SD2 and SD3 is less than or equal to ¼ the thickness TH of the thermistor body 3.

As described above, in the present embodiment, the NTC thermistor element T1 is of less than 0402 size. The NTC thermistor element T1 includes the thermistor body 3, the pair of external electrodes 5, and internal electrodes 11, 13, and 15. The internal electrode 11 and the internal electrode 13 are separated from each other in the first direction D1 in which the pair of external electrodes 5 oppose each other with the thermistor body 3 interposed therebetween. The internal electrode 15 opposes the internal electrodes 11 and 13, and is not connected to each external electrode 5. Each of the shortest distances SD2 and SD3 is smaller than each of the shortest distances SD1, SD4, and SD5 and is less than or equal to ¼ the thickness TH of the thermistor body 3.

Therefore, even when the NTC thermistor element T1 is of less than 0402 size, the NTC thermistor element T1 reduces the variation in the resistance value.

The NTC thermistor element T1 is of 0201 size.

A volume of the thermistor body 3 included in the NTC thermistor element being of 0201 size is smaller than a volume of the thermistor body included in the NTC thermistor element being of more than or equal to 0402 size. Therefore, the NTC thermistor element T1 being of 0201 size is excellent in thermal responsiveness.

The NTC thermistor element T1 includes the coating layer 21. The coating layer 21 covers the surface of the thermistor body 3 and is made of a glass material.

The configuration in which the coating layer 21 made of a glass material covers the surface of the thermistor body 3 ensures electrical insulation of the surface of the thermistor body 3.

In the NTC thermistor element T1, the dummy electrode 17 is separated from the internal electrode 15 in the first direction D1 and is connected to the one of the external electrodes 5. The dummy electrode 19 is separated from the internal electrode 15 in the first direction D1 and is connected to the other external electrode 5.

Since the NTC thermistor element T1 includes the dummy electrodes 17 and 19, the NTC thermistor element T1 controls the variation in distance (interlayer distance) between the internal electrode 11 and the internal electrode 15 and the variation in distance (interlayer distance) between the internal electrode 13 and the internal electrode 15. Therefore, the NTC thermistor element T1 further reduces the variation in the resistance value.

Each of the lengths Ld1 and Ld2 is smaller than the length Le1 of each external electrode 5 and is larger than each of the shortest distances SD2 and SD3.

Therefore, the NTC thermistor element T1 further reliably reduces the variation in the resistance value.

Although the embodiment and modification of the present invention have been described above, the present invention is not necessarily limited to the above-described embodiment and modification, and the embodiment can be variously changed without departing from the spirit of the invention.

Figure 8:
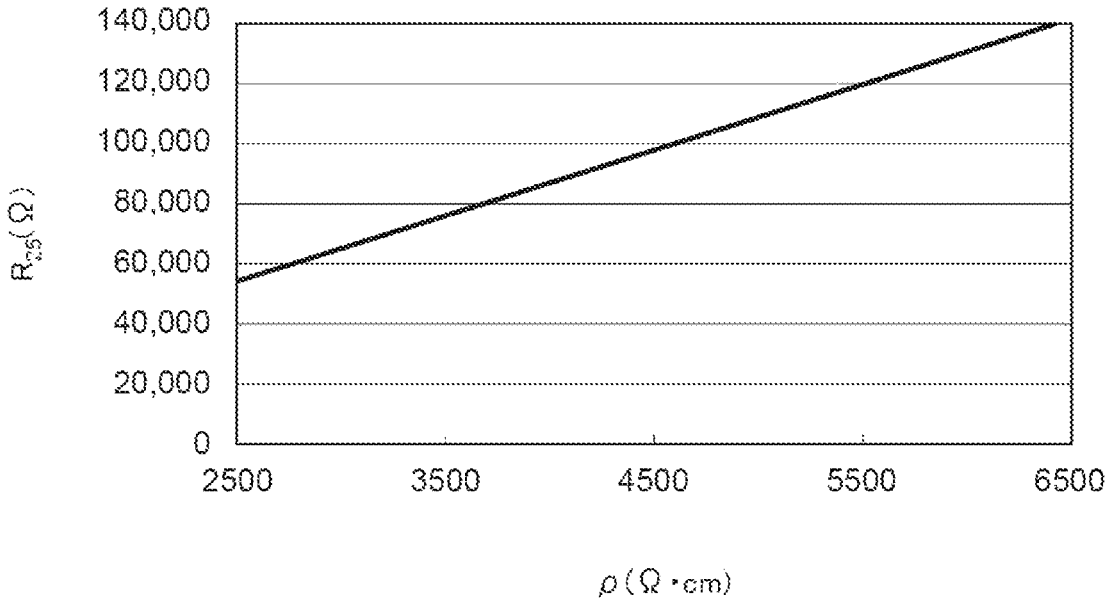
FIG. 8 is a diagram illustrating a cross-sectional configuration of an NTC thermistor element according to a modification of the present embodiment.

As illustrated in FIG. 8, the NTC thermistor element T1 may not include the dummy electrodes 17 and 19. The NTC thermistor element T1 not including the dummy electrodes 17 and 19 also reduces the variation in the resistance value.

Each of the numbers of the internal electrodes 11 and 13 is not limited to two. Each of the numbers of internal electrodes 11 and 13 may be one. Each of the numbers of internal electrodes 11 and 13 may be three or more. In this case, the number of internal electrodes 15 may be two or more.

INDUSTRIAL APPLICABILITY

The present invention can be used for NTC thermistor elements.

REFERENCE SIGNS LIST

3: thermistor body, 5: external electrode, 11, 13, 15: internal electrode, 17, 19: dummy electrode, 21: coating layer, D1: first direction, D2: second direction, D3: third direction, T1: NTC thermistor element.

The invention claimed is:

1. An NTC thermistor element comprising:

a thermistor body;

a first external electrode disposed on one end of the thermistor body;

a second external electrode disposed on another end of the thermistor body; and a plurality of internal electrodes disposed in the thermistor body, wherein the plurality of internal electrodes include:

a first internal electrode connected to the first external electrode;

a second internal electrode separated from the first internal electrode in a first direction in which the first external electrode and the second external electrode oppose each other with the thermistor body interposed therebetween, and connected to the second external electrode; and a third internal electrode opposing the first internal electrode and the second internal electrode, and not connected to the first external electrode and the second external electrode, wherein a shortest distance between the first internal electrode and the third internal electrode and a shortest distance between the second internal electrode and the third internal electrode are smaller than:

a shortest distance between the first internal electrode and the second internal electrode, a shortest distance between the first external electrode and the third internal electrode, and a shortest distance between the second external electrode and the third internal electrode, wherein the shortest distance between the first internal electrode and the third internal electrode and the shortest distance between the second internal electrode and the third internal electrode are less than or equal to ¼ a thickness of the thermistor body in a second direction in which the first and second internal electrodes and the third internal electrode oppose each other, and wherein the NTC thermistor element is of less than 0402 size.

2. The NTC thermistor element according to claim 1, wherein the NTC thermistor element is of 0201 size.

3. The NTC thermistor element according to claim 1, further comprising a layer covering a surface of the thermistor body and made of a glass material.

4. The NTC thermistor element according to claim 1, wherein the plurality of internal electrodes further include:

a first dummy electrode separated from the third internal electrode in the first direction, and connected to the first external electrode; and a second dummy electrode separated from the third internal electrode in the first direction, and connected to the second external electrode.

5. The NTC thermistor element according to claim 4, wherein a length of the first dummy electrode in the first direction is smaller than a length of the first external electrode in the first direction and is larger than the shortest distance between the first internal electrode and the third internal electrode and the shortest distance between the second internal electrode and the third internal electrode, and wherein a length of the second dummy electrode in the first direction is smaller than a length of the second external electrode in the first direction and is larger than the shortest distance between the first internal electrode and the third internal electrode and the shortest distance between the second internal electrode and the third internal electrode.

6. The NTC thermistor element according to claim 1, wherein a resistivity (ρ) of the thermistor body satisfies a relational expression of $$\rho=\alpha\times(S\times n/T)\times R_{25}$$

including:

a total value (S) of an area of a region where the first internal electrode and the third internal electrode overlap in the second direction and an area of a region where the second internal electrode and the third internal electrode overlap in the second direction;

the number (n) of regions located between the first and second internal electrodes and the third internal electrode in the thermistor body, in the second direction;

an interval (T) between the first and second internal electrodes and the third internal electrode in the second direction;

a coefficient (α) dependent on a resistance value of a portion other than the thermistor body; and a zero load resistance value ($R_{25}$) at 25° C. in the thermistor body.

7. The NTC thermistor element according to claim 1, wherein the thermistor body includes a pair of main surfaces opposing each other, a pair of side surfaces opposing each other, and a pair of end surfaces opposing each other, the first internal electrode includes one end exposed to one of the end surfaces, and is not exposed to the main surfaces and the side surfaces, the second internal electrode includes one end exposed to another of the end surfaces, and is not exposed to the main surfaces and the side surfaces, and the third internal electrode includes no end exposed to the main surfaces, the side surfaces, and the end surfaces.

* * * * *